United States Patent [19]

Shrime

[11] Patent Number: 4,714,362

[45] Date of Patent: Dec. 22, 1987

[54] TYPEWRITER DAISY WHEEL

[75] Inventor: George Shrime, Dallas, Tex.

[73] Assignee: Contitronix Inc., Garland, Tex.

[21] Appl. No.: 387,501

[22] Filed: Jun. 11, 1982

[51] Int. Cl.[4] ..... B41J 1/30

[52] U.S. Cl. ..... 400/144.2; 400/174; 400/111

[58] Field of Search ..... 400/109–111, 400/144.2, 144.3, 174, 175

[56] References Cited

U.S. PATENT DOCUMENTS 714,621 11/1902 Tcherkassov ..... 400/111 X
4,257,711 3/1981 Nakajima ..... 400/111 X
4,357,115 11/1982 Or ..... 400/144.2 X

FOREIGN PATENT DOCUMENTS 32628 3/1980 Japan ..... 400/144.3
150555 11/1981 Japan ..... 400/144.2

OTHER PUBLICATIONS

*IBM Tech. Disc. Bulletin,* by S. A. Oleksa et al., vol. 18, No. 11, Apr. 1976, pp. 3744–3745.
*IBM Tech. Disc. Bulletin,* by Higginbotham, vol. 22, No. 10, Mar. 1980, pp. 4345–4347.

*Primary Examiner*—Paul T. Sewell
*Attorney, Agent, or Firm*—Sigalos & Levine

[57] ABSTRACT

A daisy wheel for a typewriter having a plurality of petals with a character head on the end of each petal comprising irregular width characters on the ends of the petals and means for positioning the character heads in an irregular spacing about the circumference of said daisy wheel to accommodate the irregular width characters.

9 Claims, 7 Drawing Figures

TYPEWRITER DAISY WHEEL

BACKGROUND OF THE INVENTION

The present invention relates to a daisy wheel for a printer which includes a typewriter having a plurality of petals with a character head on the end of each petal. Hereinafter reference will be made to a typewriter although the invention also relates to any printing device.

Many presently existing typewriters utilize a print element known as a daisy wheel which has a plurality of evenly spaced petals about the circumference thereof with a character to be printed on a character head at the end of each of the petals as needed. Also, some typewriters have a print element known as a "thimble" because it is so shaped and which also has evenly spaced petals about the circumference thereof. Hereinafter, the term "daisy wheel" is also intended to include print elements such as "thimbles". These daisy wheels all have a common construction in that the petals are evenly spaced and each occupies one of the petal positions about the circumference of the daisy wheel. Normally there are 96 such positions, although in some cases there have been 100, in other cases 88 and, more recently, one daisy wheel had 400 characters thereon. The use of such a daisy wheel having equally spaced petals about the circumference thereof creates considerable difficulty when attempting to provide a print element with an alphabet such as Arabic, Farsi, Hebrew, Urdu, and the like because, in some cases, the characters are so irregularly shaped and variable in width that to type certain of these characters they have to be broken into segments and successive impressions are required which join the segments together when printed so as to form the proper character. Obviously such a procedure requires extremely accurate positioning of the successive character segments so that, when joined together, they appear as one. Further, difficulties are created in the stepping of the print wheel so that the petal is in the proper location to cause the printed segments to be joined.

Further, some characters require a dot or dots to be associated with them. Where the dot or dots are on the same character head with their associated characters as in the prior art, a large number of character heads are required to provide all such characters. Applicant avoids this problem by placing the dot or dots on a separate character head thus reducing the number of character heads required. This provides additional petal space which can be used in the present invention for wider character heads because less petals are required.

Thus, in summary, when letters such as Arabic letters are to be printed by prior art printers, some of them are so wide that the continuous portion is broken into segments with one segment being on the end of one petal and another successive segment being on the end of another petal. This requires more than one impression to form the continuous portion of a character and the portions of the character must meet perfectly so that the entire continuous character appears normal. Any slight imperfection in the positioning of either the print element or the carriage assembly results in the printing of an imperfect character because the two segments would not be joined properly. Further, by the use of a dot or dots on a separate character head, the number of petals required to include all characters is significantly reduced over the prior art thus allowing the extra petal spaces provided to be used for wider characters.

SUMMARY OF THE INVENTION

The present noval daisy wheel has petals with character heads attached in an irregular spacing about the circumference of the daisy wheel with irregular width character heads on the ends of selected ones of the pegals to accommodate irregularities in the width of the characters. In other words, one large character may be formed instantly by using a petal with a character head having a large character thereon that uses all or some of the space occupied normally by the character heads of two adjacent petals. In the prior art, the centers of the petals are equally spaced about the circumference of the daisy wheel, and each character head on the end of each petal is equally spaced from the others and occupies or uses only one petal space.

In the present application, the unique characters are so arranged on the petals that a character requiring a dot or dots is typed with the character body printed first and then the dot or group of dots is printed. This allows all of he desired characters to be printed without requiring as many petals on the daisy wheel as required by the prior art to print the same number of characters.

Thus, the present invention relates to a daisy wheel for a typewriter having a plurality of petals with a character head on the end of each petal comprising irregular width characters on the ends of said petals and means for positioning said characters in an irregular spacing about the circumference of said daisy wheel to accommodate said irregular width characters.

BRIEF DESCRIPTION OF THE DRAWINGS

These and other objects and advantages of the present invention will be disclosed in the course of the following specification, reference being had to the accompanying drawings, in which.

DETAILED DESCRIPTION OF THE DRAWINGS

Figure 1:
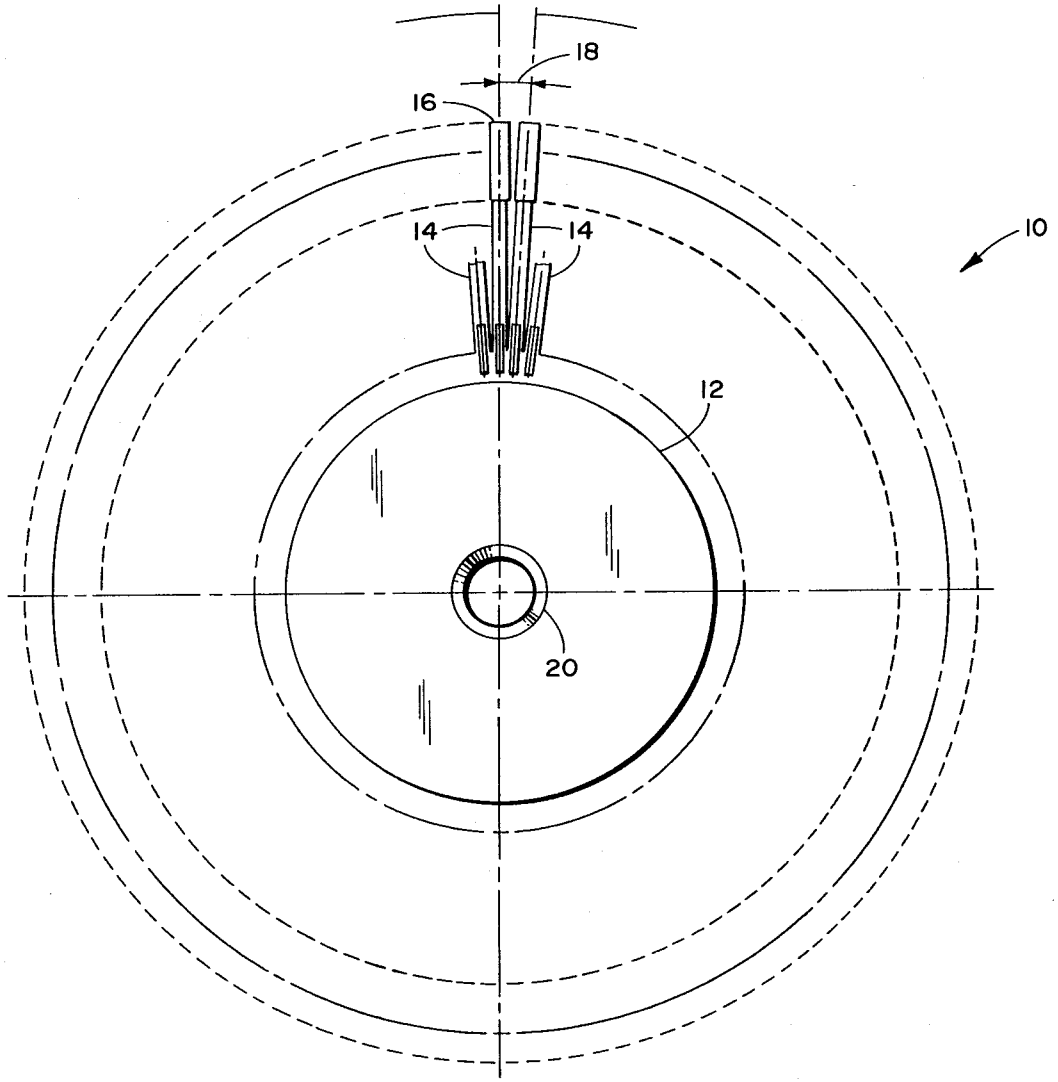
FIG. 1 is a back view of a prior art daisy wheel print element.

FIG. 1 is a partial back view of a prior art daisy wheel, illustrated generally by the numeral 10, having attached to the center 12 thereof a plurality of petals 14, each having on the end thereof a character support or head 16. The angle 18 between the centerline of adjacent petals is equal to 360 degrees divided by the number of petals. Thus, if 96 petals were used, the angle 18 would be 3 degrees, 45 minutes. An orifice 20 exists in the center of the daisy wheel which is utilized to mount the daisy wheel on the mating attachment on the typewriter on which it is to be used. In the view shown in FIG. 1, the characters on the heads 16 are on the front side of the petals and, thus, are not shown. Thus, it can be seen from FIG. 1 that the prior art daisy wheels have petals 14 which are equally spaced about the circumference of the daisy wheel and that each character support or head 16 is equally spaced from the others and occupies a slot or position reserved for the particular petal to which it is attached.

Figure 2:
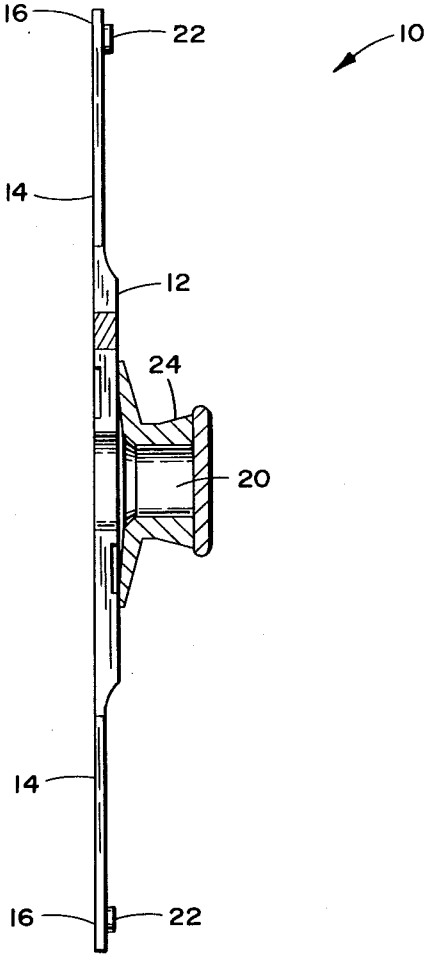
FIG. 2 is a cross-sectional side view of the prior art daisy wheel print element.

FIG. 2 is a cross-sectional side view of the prior art daisy wheel shown in FIG. 1 and illustrates orifice 20 in the center of daisy wheel 10 which is mounted on the mating attachment on the typewriter. It also illustrates the petals 14 attached to the body 12 and the character support or head 16 on the end of the petals. In addition, it illustrates the character 22 which is mounted on the character support or head 16. Projection 24 having orifice 20 therein provides a means for both mounting the daisy wheel on the typewriter or printer and grasping it and removing it from the mating attachment on the typewriter.

Figure 3:
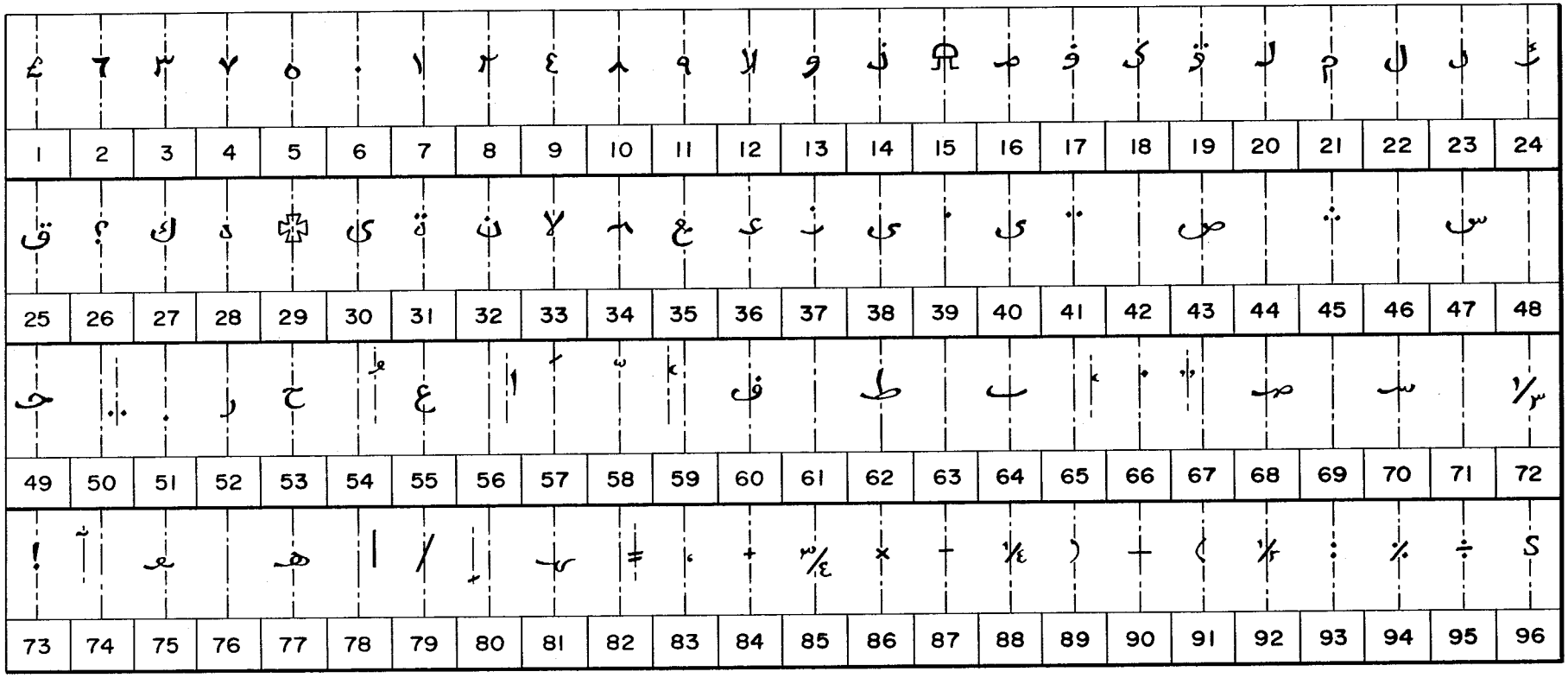
FIG. 3 is a table of Arabic characters to be used on the daisy wheel print element of the present invention illustrating which character appears in which petal positions and illustrating which petal positions are empty and which petal positions are moved either left or right (clockwise or counterclockwise) one-quarter of a step.

FIG. 3 is a chart type representation of the characters which are used in the particular petal positions of the novel daisy wheel print element. Thus, as can be seen, 96 petal positions are represented on the chart. However, it will be noted that characters in positions 1 through 41 each occupy one petal position, while petal positions 42 and 44 are empty. This means that there are no petals in positions 42 and 44. This allows the petal in position 43 to have a character support or head with a very large character thereon which can extend over into the areas which normally would have been occupied by petals in positions 42 and 44. Also, while a petal with a character occupies position 45, positions 46 and 48 are empty and do not have petals, thus allowing petal 47 to have a very large character on the end thereof which extends into the petal positions 46 and 48 on either side thereof. In like manner, position 49 has a large character but not one as large as the characters in positions 43 and 47. This character in position 49 can overlap into the empty slot in position 48 but position 50 has a petal and difficulty could be encountered between the two petals. Thus, the petal in position 50 is moved one-quarter of a position to the right as indicated. It can be moved to the right as shown because both it and the character in petal position 51 are small characters and thus the character heads will not interfere with each other. In like manner, the petal in position 54 is moved one-quarter step to the right to allow the larger character in position 53 to overlap into petal position 54. Similarly, the petal in position 56 is moved slightly to the right one-quarter of a step to allow overlap into that area by the slightly larger character in position 55. Character 60 is one of the larger characters and, therefore, the petal position 61 is vacant while the petal in position 59 is moved backward one-quarter of a step because of the small character on the end of that petal, and this provides proper spacing for the character head on the petal in position 60 and the large character thereon. Again, the petal in position 62 has a large character thereon and thus the petal positions 61 and 63 on either side thereof are vacant to accommodate the large character. Also, the character in position 64 is a large character and the petal position 63 on one side is vacant and petal position 65 on the other side has a small character and, the petal in petal position 65 is moved to the right by one-quarter of a space to allow room for the large character in petal position 64. The same situation occurs with respect to petal position 68, which has a large character therein and a vacant petal position 69 with the other adjacent petal in petal position 67 being moved one-quarter of a space to the left. This is possible because the petal in position 66 has a small character and thus the petals on either side thereof in positions 65 and 67, both of which have small characters, can be moved toward petal position 66 one-quarter of a step. Again, petal position 70 has a large character and thus petal positions 69 and 71 on each side thereof are vacant. A similar analysis can be made of petal positions 74, 75, 76, 77, 78, 79, 80, 81 and 82. Thus, of the 96 petal positions, it will be seen that 87 of them actually have petals therein, and of those 87, 9 of them are moved one-quarter of a step either to the right or to the left of the normal petal position to accommodate the larger sized characters on either or both sides thereof.

It will also be noted in FIG. 3 that character positions 39, 41, 45, 50, 51 and 93 include one or more dots. The valued feature of having the dots formed as characters on separate petals is that this construction of the daisy wheel allows a character requiring a character segment and a dot or dots to be formed in two successive and separate petal strokes. Thus, character 43 may require one dot above the right portion thereof to form the final character. Therefore, character 43 would be first struck followed by the dot in character position 39. This arrangement provides a clean, clear character which, in the prior art, is formed by two character segments one of which segments included the dot in a spaced apart relationship. Further by placing the dot or dots on separate character heads, a larger number of characters can be typed with fewer print heads or petals than required in the prior art to print the same number of characters.

Figure 4:
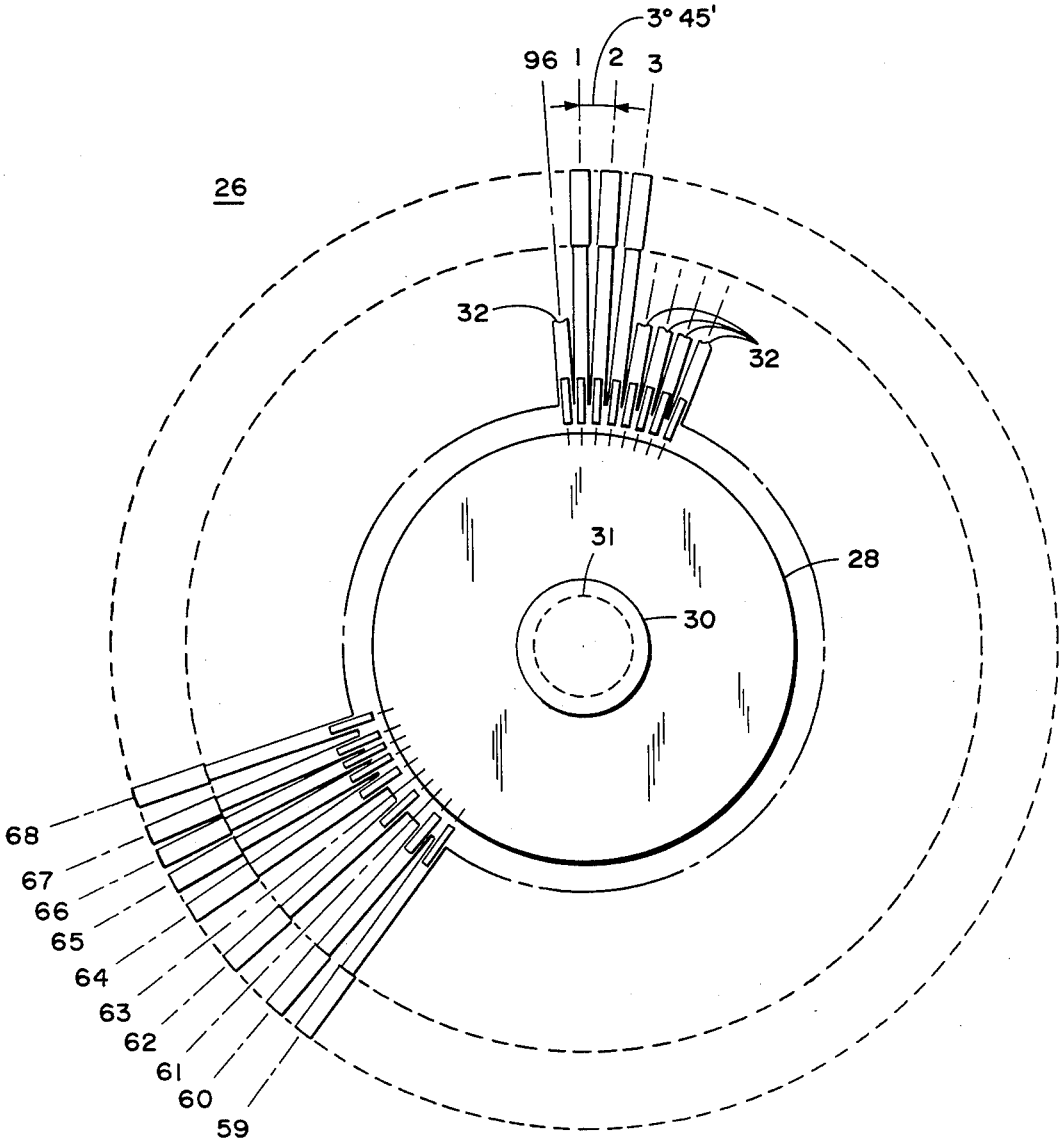
FIG. 4 is a front view of the novel daisy wheel print element of the present invention illustrating in part some of the petals mounted about the circumference of the daisy wheel and also illustrating in part how some of the petals are missing in some positions or have the petals moved clockwise or counterclockwise one-quarter of a position to accommodate large width characters or character heads on the ends of adjacent petals and illustrating how characters on the ends of certain petals may occupy more than on petal position.

FIG. 4 is a partial front view of the novel daisy wheel of the present invention. The daisy wheel is designated generally by the numeral 26 and has a center portion 28 on which is a protrusion or knob 30 which can be utilized to remove the daisy wheel from the corresponding attachment on the typewriter. On the other side of the daisy wheel, under protrusion or knob 30, is an orifice 31 (shown in dashed lines) which slides over an attachment on the typewriter. As can be seen, there are 96 petal positions, each spaced 3 degrees, 45 seconds from the other. However, petals 32 do not occupy every petal position, nor do all of the petals lie exactly on the centerlines of the 96 positions. Thus, position 61 has no petal at all and neither does position 63, as shown. However, the petal in position 62 carries a large character (see FIG. 3) which extends over into the area of positions 61 and 63 on either side thereof. In like manner, the petal in position 65 is rotated clockwise one-quarter of a position and thus is not centered on the centerline of petal position 65. By moving the petal forward one-quarter position, more room is made for the large character head to be used on the petal in position 64 (see FIG. 3). In like manner, the petal in position 67 is moved back, or counterclockwise, one-quarter position to allow the larger head to be used on the petal in position 68 to extend into that area. Thus, it can be seen that while there are a plurality of equally spaced petal positions about the circumference of the daisy wheel, only predetermined ones of the petals (as indicated in FIG. 3) are positioned on, before or after said equally spaced positions whereby the petals are irregularly spaced about the circumference of the daisy wheel 26. Further, it can be seen from FIG. 3 that the characters on the ends of the petals in positions 59, 60, 62, 64, 65, 66, 67 and 68 are irregularly sized in width whereby each of the character heads may occupy more than or the same space as one of the normal petal positions.

Figure 5:
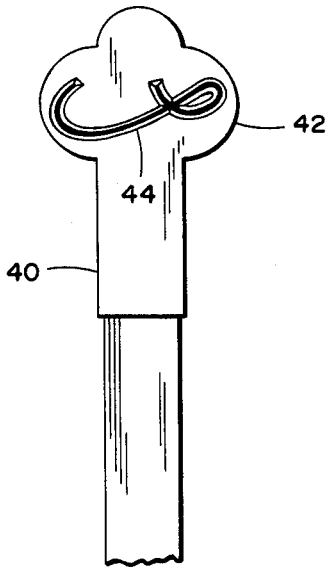
FIG. 5 is a partial front view of one of the petals on the novel daisy wheel illustrating a character thereon which is character 43 in FIG. 3.
Figure 6:
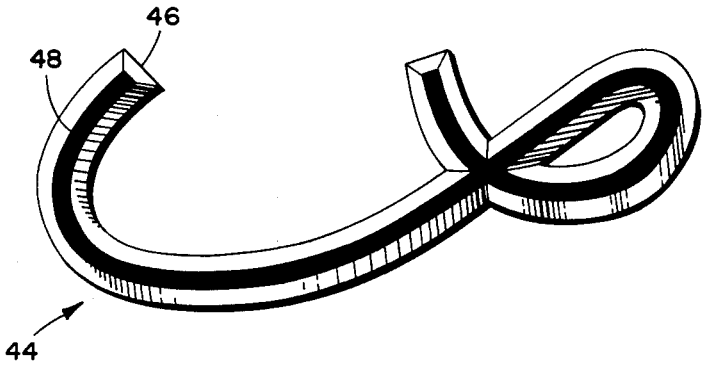
FIG. 6 is an enlarged version of the character shown on the petal in FIG. 5 and in position 43 in FIG. 3.

FIG. 5 is a partial view of one of the petals 40 illustrating the character support or head 42, on which a character 44 is mounted. The character 44 happens to be the character shown in position 43 in FIG. 3. The shape of the character support or head 42 is unimportant, except that it must be constructed to allow for structural strength in the operation of the petal. As can be seen in greater detail in FIG. 6, the character is raised and constructed such that just the upper edge 48 strikes the paper.

Figure 7:
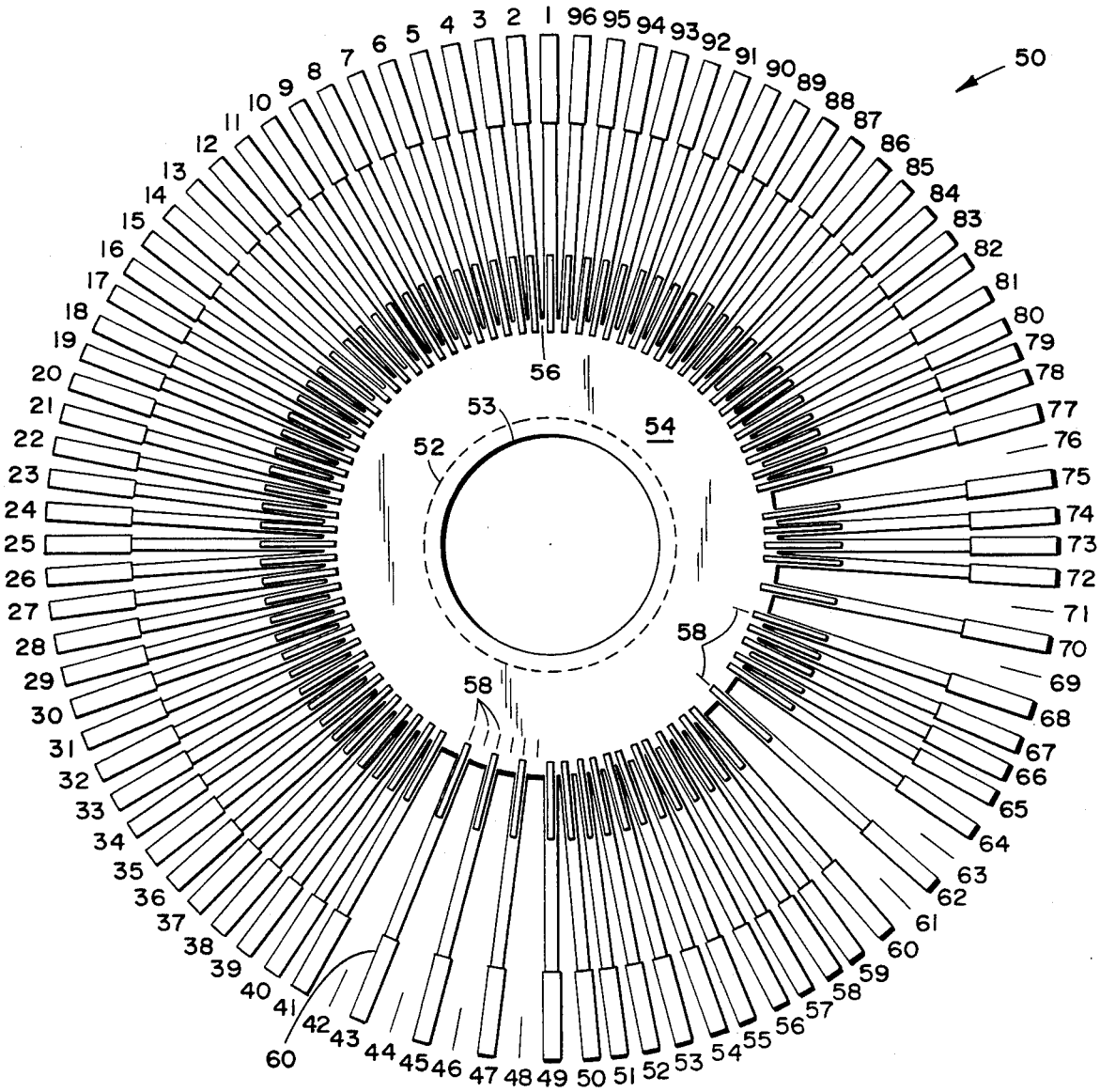
FIG. 7 is a back view of the novel daisy wheel of the present invention illustrating the characters on the petals in their proper positions and the irregular spacing of the petals to accommodate the character heads of variable width.

FIG. 7 is a back view of the novel daisy wheel of the present invention and designated generally by the numeral 50. Removal knob 52 is attached to the center of the daisy wheel body 54 and includes orifice 53. Attached to the body in a well known manner are the petals 56. The dashed lines 58 represent the centerlines of the 96 petal positions and, thus, it can be seen in FIG. 7 those positions which have no petals located therein and those positions wherein the petals have been moved offcenter, either to the right or to the left one-quarter position. While the petals are not shown with character supports or heads 60 having a particular shape, it should be understood that the shape itself is not important except to give strength to the character so that the petals have a long life. Further, each numbered petal would have a character support or head 60 thereon with the character shown in the table in FIG. 3 having a corresponding number. Thus, the character given number 10 in FIG. 3 is the same character that would be positioned on petal 10 in FIG. 7.

Thus, there has been disclosed a novel daisy wheel for typing alphabets such as Arabic, Farsi, Hebrew, Urdu and the like which has irregular sized characters on the ends of selected ones of the petals forming the daisy wheel and means for attaching the petals to the daisy wheel in an irregular spacing about the circumference of the daisy wheel to accommodate the irregular sized characters, thus allowing large characters to occupy more than one petal space and to be printed in one operation rather than multiple operations. It should be understood that the shape of the petals and the shape of the character support for the heads are not critical. Rather, the positioning of the petals in an irregular spacing and the irregular width character heads thereon are the important features of this invention.

While the invention has been described in connection with a preferred embodiment, it is not intended to limit the scope of the invention to the particular form set forth, but, on the contrary, it is intended to cover such alternatives, modifications, and equivalents as may be included in the spirit and scope of the invention as defined by the appended claims.

What is claimed is:

1. A daisy wheel for a printer having a plurality of petals with a character head on the end of each petal comprising:

(a) a plurality of equally spaced petal positions about the circumference of said daisy wheel, and (b) pre-determined ones of said petals positioned on, before or after said equally spaced positions whereby such petals are irregularly spaced about the circumference of said daisy wheel.

2. A daisy wheel as in claim 1 further comprising:

(a) irregular width characters on said petals whereby each of said characters may occupy more than or the same space as one of said petal positions.

3. A daisy wheel as in claim 2 including separate character heads for a dot or dots whereby a character having a segment and a dot or dots is formed by two separate petal strokes, one for the segment and one for the dot or dots.

4. A daisy wheel for printers for printing a language comprising:

(a) first irregularly spaced petals having character heads with character segments thereon and (b) second petals having character heads with one, two or three dots thereon whereby characters requiring a dot or dots are printed in two successive and separate petal strokes, one for the character segment and one for the dot or dots.

5. A daisy wheel for a printer having a plurality of petals with a character on the end of each petal and comprising:

a. irregular width characters on the ends of said petals, and b. means for attaching said petals about the circumference of said daisy wheel in an irregular spacing thereby accommodating said irregular width characters.

6. A daisy wheel as in claim 5 wherein selected ones of said characters include one or more dots whereby characters with a dot or dots are printed in two successive and separate petal strokes, one for the character segment and one for the dot or dots.

7. A method of forming a daisy wheel for a printer having a plurality of petals with a character on the end of each petal, comprising the steps of:

(a) forming irregular width characters on the ends of said petals, and (b) attaching said petals to said daisy wheel in positions irregularly spaced about the circumference of said daisy wheel to accommodate said irregular width characters.

8. A method as in claim 7 including the step of forming selected ones of said irregular width characters to occupy more or the same space than one of said petal positions.

9. A method as in claim 8 further including the step of forming one or more dots as selected ones of said characters whereby characters with a dot or dots are printed in two successive and separate petal strokes, one for the character segment and one for the dot or dots.

* * * * *